US009192992B2

(12) United States Patent
McAnally et al.

(10) Patent No.: US 9,192,992 B2
(45) Date of Patent: Nov. 24, 2015

(54) METHOD FOR MANUFACTURE OF LAMELLAR METAL PARTICLES

(75) Inventors: Jeff McAnally, Ramona, CA (US); Michael Williams, San Diego, CA (US)

(73) Assignee: Metal Flake Technologies, LLC, Nashville, TN (US)

( * ) Notice: Subject to any disclaimer, the term of this patent is extended or adjusted under 35 U.S.C. 154(b) by 1187 days.

(21) Appl. No.: 13/069,964

(22) Filed: Mar. 23, 2011

(65) Prior Publication Data

US 2011/0236687 A1 Sep. 29, 2011

Related U.S. Application Data

(60) Provisional application No. 61/316,630, filed on Mar. 23, 2010.

(51) Int. Cl.

| | |
|---|---|
| ***B22F 9/04*** | (2006.01) |
| ***B22F 7/04*** | (2006.01) |
| ***B22F 1/00*** | (2006.01) |
| ***C22C 1/10*** | (2006.01) |

(52) U.S. Cl.

CPC ..... *B22F 7/04* (2013.01); *B22F 1/0055* (2013.01); *C22C 1/1084* (2013.01); *B22F 2009/043* (2013.01); *Y10T 428/2982* (2015.01)

(58) Field of Classification Search

USPC ..... 75/343; 419/33

See application file for complete search history.

(56) References Cited

U.S. PATENT DOCUMENTS

| | | | | |
|---|---|---|---|---|
| 2,274,766 | A * | 3/1942 | Ziehl | 241/3 |
| 3,389,105 | A | 6/1968 | Bolger | |
| 3,941,584 | A | 3/1976 | Tundermann et al. | |
| 3,995,815 | A | 12/1976 | Megelas | |
| 4,115,107 | A | 9/1978 | Booz et al. | |
| 4,469,282 | A | 9/1984 | Booz | |
| 2005/0150984 | A1 | 7/2005 | Savin | |
| 2006/0225533 | A1 | 10/2006 | Minami | |

FOREIGN PATENT DOCUMENTS

| | | |
|---|---|---|
| WO | 2004/026508 | 4/2004 |

* cited by examiner

*Primary Examiner* — George Wyszomierski
*Assistant Examiner* — Ngoclan T Mai
(74) *Attorney, Agent, or Firm* — Waller Lansden Dortch & Davis, LLP; Matthew C. Cox

(57) ABSTRACT

A method for converting spherical or amorphous metal particles into lamellar flakes that promote improved adhesive and cohesive characteristics when incorporated into coating compositions. The metal flakes produced exhibit properties compatible with binder chemistries such as isocyanates, titanates, titanate hybrids and are suitable for use in conjunction with advanced top coating techniques, such as electrodeposition. The particles produced by the method may be used in coatings and may exhibit improved substrate adhesion and improved cohesion characteristics when used in conjunction with an electrodeposition top coat.

16 Claims, 3 Drawing Sheets

METHOD FOR MANUFACTURE OF LAMELLAR METAL PARTICLES

This application claims benefit of the following patent application which is hereby incorporated by reference: U.S. Provisional Application No. 61/316,630, which was filed on Mar. 23, 2010.

TECHNICAL FIELD

The present disclosure relates generally to a method for the production of lamellar metal flakes having a major dimension and a minor dimension, the major dimension measuring less than about 70 μm in length, from a starting material of spherical or amorphous metal particles or metal powder. The lamellar metal flakes produced by the inventive method have an aspect ratio of between about 3:1 and about 5:1 (length: width) and are suitable for many applications, including for direct incorporation into coating compositions that can provide an adherent coating on a substrate, such as a metal substrate.

BACKGROUND

A conventional method for producing metal flakes involves the use of a ball mill in which starting metal particles are tumbled together to form metal flakes. One such method is described in U.S. Pat. No. 4,469,282, which describes the production of metal flake in a wet mill grinding operation. Indeed, the primary commercial method with which metal flake is made employs a wet ball milling technique. This technique creates lamellar metal particles in an aqueous phase of, for example, an organic liquid. However the wet method requires use of specialized equipment to handle its volatile solvents and also creates a hazardous waste stream, which may lead to increased production costs.

On the other hand, metal flake can be produced using a dry method, wherein flakes are produced in air or gas and wherein the use of volatile solvents can be avoided. The dry method is time dependent, and particles are milled for an optimum time, as determined by one of skill in the art. According to U.S. Pat. No. 4,115,107, care must be taken that dry milling not continue for too long a period because continued pounding of the particles by the milling media may result in cold welding or irreversible agglomeration. The dry method has not been widely adopted.

Zinc particles are used in various types of coating compositions. Such particles exist in three forms: powder, dust and flake. Zinc in the form of a flake has significantly greater surface area and reactivity than dust or powder and therefore has attractive commercial applications. Zinc flake has been produced by various methods, and zinc-containing coating compositions are used to protect ferrous-containing surfaces, among others.

For example, U.S. Pat. No. 3,389,105 describes a procedure for making flake metal powder for incorporation into metallic pigments in inks, paints and the like, i.e. in dispersion in a suitable film-forming vehicle to provide a protective or decorative surface-coating composition.

Zinc flakes may be mixed with a binder, initially in a liquid composition but subsequently in a solid composition after curing and/or drying. The binder creates a matrix that incorporates the particles in a coherent mass that is bonded to the surface of a substrate. For use in a paint, the zinc flakes and binder are initially mixed with a liquid paint vehicle, which serves to allow the mixing and applying of the paint to the substrate and thereafter dries and evaporates to leave a paint coating mixture of particles and binder adhered to the substrate.

The coating of surfaces, such as ferrous-containing surfaces, with zinc-containing coating compositions has several purposes. One purpose is for pure esthetics, but mainly zinc-containing coating compositions function to prevent rust and corrosion. Indeed, preventing or inhibiting rust and corrosion can save hundreds of millions of dollars annually for industrial and consumer users.

Whether used as a coating for a wrought iron deck railing at a residence or apartment building or for coating the metal surfaces of a bridge or similar structure, the extent to which corrosion and rusting is prevented can have a significant impact on the useful life of a structure. Thus, intra-coating cohesive properties, meaning those measuring the strength of the internal bond of the topcoat rather than the bond between the topcoat and the substrate, are important, as are the adhesive qualities of a coating applied to a substrate.

It is known to mix a small portion of metal flake as an additive with paint and other coating materials to prolong the life of a surface covered by the improved coating material. Moreover, lamellar particles enhance the pot life of liquid coatings by improving settling characteristics, and they also lengthen the service life of a dry film by increasing cathodic protection and by creating an improved barrier to environmental exposure. However, there is a need in the art for a milling process that will produce a metal flake additive having improved adhesive and cohesive performance characteristics and displaying the requisite characteristics to allow for inclusion in certain modern binder chemistries so that metal flakes may be used in conjunction with advanced modern top coating techniques.

The present disclosure provides a metal flake, and a method for production thereof, having improved adhesive and cohesive properties, which facilitate the production of coating compositions exhibiting improved adhesive and cohesive qualities. These and other advantages of the present disclosure will be apparent from the description set forth below.

SUMMARY

Disclosed herein are methods for deforming metal particles using various milling techniques, such as ball milling. In an embodiment, the present disclosure relates to a new and useful method of converting spherical or amorphous metal particles, particularly zinc particles, into lamellar flakes that have an aspect ratio of between about 3:1 and about 5:1 (length:width) and that provide improved adhesive and cohesive properties as compared to the prior art.

The method(s) of the present disclosure may include manipulation of any metal(s) having suitable malleability, such as zinc, copper, aluminum, nickel, and the like, in a manner that may increase the adhesive and/or cohesive properties of particles of such metals. Indeed, the metal flake product and/or lamellar particles produced by the method(s) may be used in performance coatings, and each exhibits improved substrate adhesion and superior cohesion characteristics when used in conjunction with a top coat.

In some embodiments, the disclosure describes a method for converting spherical or amorphous metal particles into lamellar flakes that promote improved adhesive and cohesive characteristics when incorporated into coating compositions. The metal flakes produced exhibit properties compatible with binder chemistries such as isocyanates, titanates, titanate hybrids and are suitable for use in conjunction with advanced top coating techniques, such as electrodeposition. The particles produced by the method may be used in coatings and may exhibit improved substrate adhesion and improved cohesion characteristics when used in conjunction with an electrodeposition top coat.

One aspect of the disclosed method(s) is to provide new and improved procedures for making flake metal particles. Another aspect is to provide a metal-flake product, such as a lamellar metal flake, having improved adhesive and cohesive properties. A further aspect is to provide procedures that can produce lamellar particles and that are suitable for a ball milling operation. Yet another aspect is to provide methods and materials for making metal flakes. Still another aspect is to provide zinc flakes for use in conjunction with advanced top coating techniques, such as electrodeposition. These and other aspects of the present disclosure will become apparent in view of the following detailed description.

In one embodiment, the present disclosure teaches a method of producing lamellar metal particles, comprising (i) adding an amount of metal charge to a mill, wherein the mill contains an amount of milling media, (ii) adding to the mill a milling lubricant, (iii) adding to the mill an anti-welding additive, (iii) operating the mill at between about 14 and about 45 rotations per minute (rpm) for between about 6 and about 18 hours, (iv) providing or maintaining an internal mill temperature between about 140° F. and about 380° F., and (v) separating the resulting metal flake product from the milling media.

In some embodiments, the present disclosure provides a method of producing lamellar metal particles in a ball mill, wherein the ball mill comprises an internal mill chamber and further wherein the internal mill chamber contains an amount of grinding media having a mass, the method comprising the steps of: (i) adding an amount of a metal charge having a mass that is between about 2% and about 12% of the mass of the grinding media to the internal mill chamber; (ii) adding an amount of a milling lubricant that is between about 0.75% and about 3% of the mass of the metal charge to the internal mill chamber; (iii) adding an amount of an anti-welding additive that is between about 0.15% and about 3.5% of the mass of the metal charge to the internal mill chamber; (iv) operating the mill at between about 14 and about 45 rpm for between about 6 and about 18 hours; (v) providing a mill chamber temperature of between about 140° F. and about 380° F.; and (vi) removing a metal flake product from the mill chamber, wherein the metal flake product comprises lamellar particles ranging in size from between about 1 and about 110 microns in major dimension.

In some embodiments, the present disclosure provides a method of producing zinc flake in a ball mill, the method comprising the steps of: (i) adding to the mill between about 250 and about 350 lbs of metal charge, wherein the metal charge comprises zinc; (ii) adding to the mill between about 2.25 lbs and about 9 lbs of stearic acid; (iii) adding to the mill between about 0.45 and about 10.5 lbs of amorphous carbon substance; (iv) rotating the mill at between about 20 and about 30 rotations per minute for between about 12 and about 18 hours; (v) providing an internal mill temperature of between about 160° F. and about 220° F.; and (vi) removing a metal flake product from the mill, wherein the metal flake product comprises zinc flakes ranging in size from between about 1 and about 110 microns in major dimension.

In certain embodiments, the present disclosure provides a method for producing zinc flakes, comprising (i) charging a ball mill, which contains grinding media, with about 300 lbs of zinc particles, about 7.5 lbs of stearic acid and about 1.5 lbs of amorphous carbon substance, (ii) operating the mill at about 25 rpm for between about 14 and about 16 hours, (iii) providing or maintaining an internal mill temperature of between about 162° F. and about 219° F., and (iv) separating the grinding media from the resulting zinc flake product.

In other embodiments, the present disclosure provides lamellar metal particle that is less than about 70 microns in major dimension prepared by a method of producing lamellar metal particles in a ball mill, wherein the ball mill comprises an internal mill chamber and further wherein the internal mill chamber contains an amount of grinding media having a mass, the method comprising the steps of: (i) adding an amount of a metal charge having a mass that is between about 2% and about 12% of the mass of the grinding media to the internal mill chamber; (ii) adding an amount of a milling lubricant that is between about 0.75% and about 3% of the mass of the metal charge to the internal mill chamber; (iii) adding an amount of an anti-welding additive that is between about 0.15% and about 3.5% of the mass of the metal charge to the internal mill chamber; (iv) operating the mill at between about 14 and about 45 rpm for between about 6 and about 18 hours; (v) providing a mill chamber temperature of between about 140° F. and about 380° F.; and (vi) removing a metal flake product from the mill chamber, wherein the metal flake product comprises lamellar particles ranging in size from between about 1 and about 110 microns in major dimension.

It is to be understood that both the foregoing general description and the following detailed description present embodiments of the disclosure and are intended to provide an overview or framework for understanding the nature and character of the disclosure as it is claimed. The description serves to explain the principles and operations of the claimed subject matter. Other and further features and advantages of the present disclosure will be readily apparent to those skilled in the art upon a reading of the following disclosure and a viewing of the drawings.

DETAILED DESCRIPTION

Figure 1:
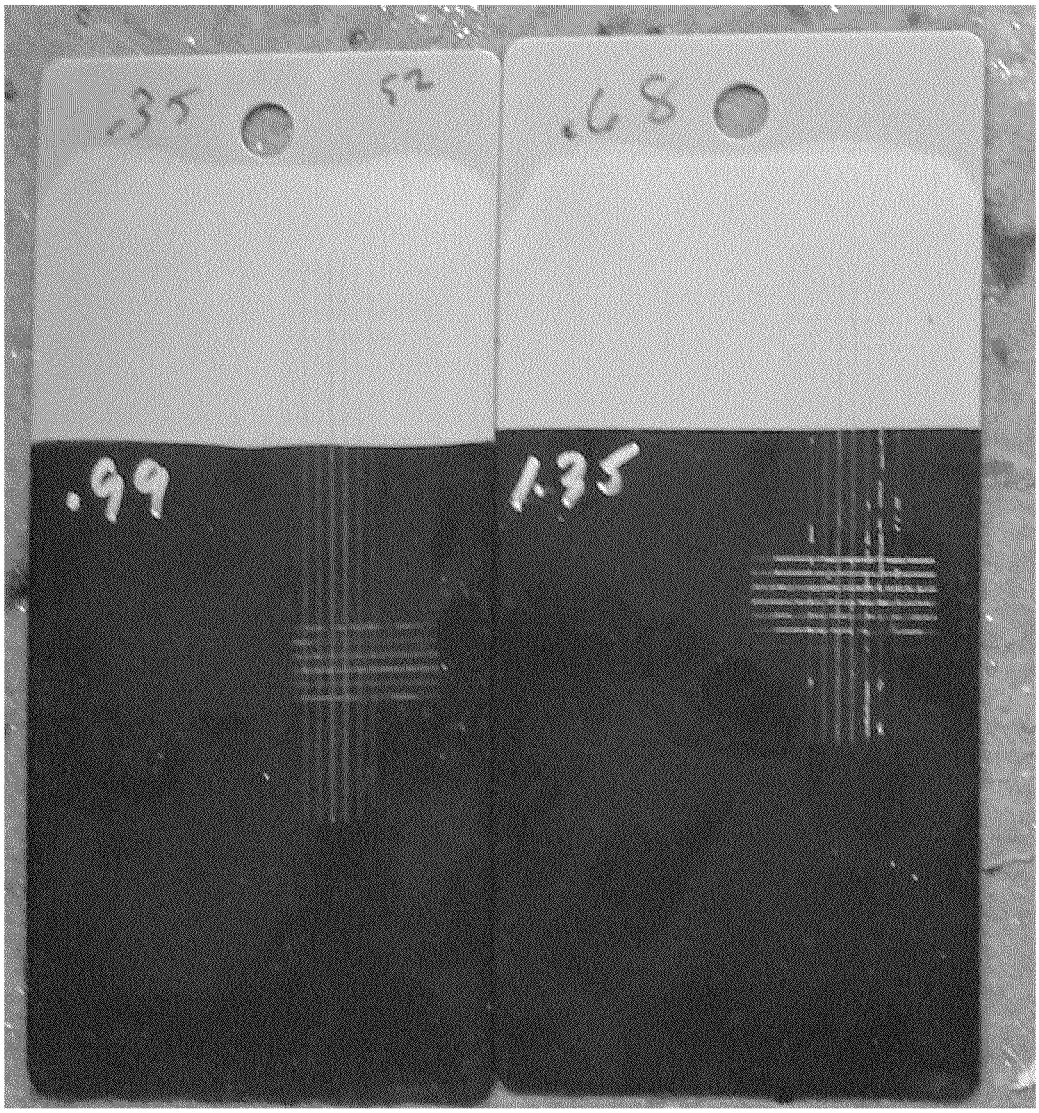
FIG. 1 is a photograph of the results of an ASTM Test Method D 3359, method B paint adhesion test.

The terms "lamellar particles," "lamellar flake," "flake," and "flake-like particles" mean metal or alloy particles produced by the method of the present disclosure. These terms are used interchangeably throughout the description. Further, "lamellar particles" or "flakes" have a structure that is primarily composed of planar layers and/or plates of atoms.

The lamellar particles produced by the method of the present disclosure have an aspect ratio of between about 3:1 and about 5:1 (length:width) and are suitable for many uses. For example, the lamellar particles produced by the method(s) of the present disclosure are suitable for direct incorporation into coating compositions that can provide a coating capable of adhering to a substrate, such as a metal substrate. In some embodiments, the aspect ratio of the lamellar particles is about 4:1 (length:width).

As used herein, the term "about" should be construed to refer to both of the numbers specified in any range. Any reference to a range should be considered as providing support for any subset within that range. Further, any numerical range recited herein is intended to include all sub-ranges subsumed therein. For example, a range of "1 to 10" is intended to include all sub-ranges between and including the minimum value of 1 and the recited maximum value of 10, that is, having a minimum value equal to or greater than 1 and a maximum value of equal to or less than 10.

All parts and percentages in the examples and throughout the specification and claims are specified by weight unless clearly implied to the contrary by the context in which the reference is made.

The methods and formulations of the present disclosure, including components thereof, can comprise, consist of, or consist essentially of the essential elements and limitations of the disclosure described herein, as well as any additional or optional ingredients, components or limitations described herein or those which are otherwise useful in milling applications or those which are otherwise known to one of skill in the art.

All references to singular characteristic(s) or limitation(s) of the present disclosure shall include the corresponding plural characteristic(s) or limitation(s), and vice versa, unless otherwise specified or clearly implied to the contrary by the context in which the reference is made.

The method of the present disclosure comprises the steps of milling metal particles to a lamellar flake form in the presence of a grinding media. Ingredients that are typically useful in milling applications, including those that are useful in ball milling applications, are contemplated herein.

The disclosed milling method may be performed in a ball mill or the like, i.e. in equipment known in the art to be useful for milling metal powders. The milling procedure(s) of the present disclosure may be carried out in a conventional ball mill, a stirred ball mill, or any other type of ball mill known in the art, wherein the ball mill is charged with an amount of grinding media, such as steel balls.

A mill useful in the method of the present disclosure will have an internal mill chamber, and the internal mill chamber will have a volume. Mills useful in some embodiments may have an internal mill volume of between about 1 and about 15,000 gallons. In other embodiments, the internal mill volume may be between about 100 and about 3,000 gallons. In some embodiments, the mill is shaped like a cylinder or tube.

In the methods of the present disclosure, metal particles are flattened into metal flakes in the mill when impacted between pieces of the grinding media and/or between the grinding media and the wall(s) of the internal chamber of the mill. The amount of grinding media that is useful in the methods of the present disclosure is dependent upon the mill volume. In some embodiments, the amount of grinding media is between about 30 and about 50% of the internal mill volume. In other embodiments, the amount of grinding media is between about 35 and about 45% of the mill volume. Further, the amount of grinding media will have a mass.

In an embodiment of the present disclosure, a charge of metal particles, also called a metal charge, may be added to the mill, specifically to the internal mill chamber, and may comprise any metal that is desirable to convert to lamellar form. In some embodiments, the metal charge comprises zinc. Metal particles comprising the metal charge are those that can be worked or formed into metal flake, including atomized metal powder, chips, fillings, borings and the like, or any mixture thereof. The particles comprising the metal charge may be in any shape or form, including spherical form or amorphous form.

In some embodiments, metal charge useful in the method of the present disclosure comprises spherical and/or amorphous zinc particles. In some embodiments, the metal charge comprises spherical zinc dust and/or spherical zinc powder. The metal charge may include particles of zinc, aluminum, copper, and other metals and alloys having malleability, such as aluminum-copper alloy, aluminum-zinc alloy and the like, or any mixture thereof.

In one embodiment, the method of the present disclosure converts spherical or amorphous charge particles, such as spherical zinc dust, into lamellar particles. In some embodiments, the metal particles are flattened, meaning that they are worked or formed into lamellar flakes.

In an embodiment, a mill, such as a ball mill, is charged with metal charge comprising zinc particles, zinc powder and/or zinc dust, wherein the metal charge particles typically have a major dimension of from about 1 to about 110 microns, which are to be milled to produce zinc flakes. The metal charge may comprise an amount of relatively pure zinc and/or an amount of zinc alloy.

In the method(s) of the disclosure, an amount of a milling lubricant may be added to the ball mill. Milling lubricants that are useful in the methods of the present disclosure include long-chain fatty acids, which typically have a carbon chain length of at least 18. Useful long-chain fatty acids may comprise saturated or unsaturated fatty acids. In some embodiments, the method of the present disclosure comprises the step of adding at least one fatty acid to the mill. Some long-chain fatty acids that are particularly useful in the method are stearic acid, lauric acid, oleic acid, behenic acid, palmitic acid and/or mixtures thereof. In some embodiments, the milling lubricant comprises polytetrafuoroethylene (PTFE). Stearic acid is conventionally employed as a milling lubricant. The milling lubricant utilized in the method of the present disclosure acts on the metal charge particles during milling to reduce friction and to aid in the creation of desirable surface characteristics, such as smoothness. In some embodiments, the metal charge particles and milling lubricant are mixed together prior to being added to the mill.

In certain embodiments, the milling lubricant may comprise a mixture of fatty acids, such as, for example, a mixture comprising stearic acid as the primary ingredient. In some embodiments, the milling lubricant may comprise a mixture of stearic acid and lauric acid. The milling lubricant may comprise a dry milling lubricant. In one embodiment, the milling lubricant comprises a dry fatty acid. Other lubricants, including, but not limited to, dry milling lubricants, may also be employed.

In an embodiment, milling lubricant is provided in an amount that is between about 0.5% and about 7% of the mass of the metal charge. In some embodiments, the amount of milling lubricant is between about 0.75% and about 3% of the mass of the metal charge. In a particular embodiment, the amount of milling lubricant is about 2.5% of the mass of the metal charge.

The method of the present disclosure may further comprise the step of adding at least one anti-welding additive to the mill. Any anti-welding additive known in the art may be used so long as the chosen anti-welding additive imparts anti-welding characteristics to a lubricant.

In some embodiments, the anti-welding additive utilized in the presently disclosed method comprises an amorphous carbon substance, such as natural graphite. In some embodiments, the anti-welding additive comprises silica. Dry anti-welding additives may provide an amorphous carbon substance such as natural graphite, granular activated carbon (GAC), powdered activated carbon (PAC), and/or synthetic graphite for use in the method of the present disclosure.

In an embodiment, the amount of anti-welding additive is between about 0.15% and about 5% of the mass of the metal charge. In another embodiment, the amount of anti-welding additive is between about 0.15% and about 3.5% of the mass of the metal charge. In yet another embodiment, the amount of anti-welding additive is between about 0.3% and about 0.7% of the mass of the metal charge. In still another embodiment, the amount of anti-welding additive is about 0.5% of the mass of the metal charge.

The terms "ball milling media", "grinding media", "milling media" and "ball media" as used herein broadly refer to any material suitable for use in milling metal powders. More particularly, the grinding media, or ball media, may comprise spherical metal balls. Further, the metal balls may comprise steel and may take the form of high-mass spheres.

Generally, spherical metal balls are the preferred milling media because they act to provide highly efficient flattening. The balls useful in the method of the present disclosure typically range in size from 3/16 inch to 3/8 inch in diameter, although in some embodiments, the balls may be smaller, e.g. as small as about 1/8 inch, or larger, e.g. up to about 1 inch, depending, to some extent, on the starting material, such as the contents of the metal charge. In some embodiments, the diameter of the balls is between about 1/8 inch and about 3/8 inch. In one embodiment, the diameter of the balls is about 9/32 inch. Moreover, other ingredients typically useful in and as grinding media are also contemplated, although they provide only a very minor amount of the total charge.

As noted, milling according to the disclosed method is typically carried out in a ball mill. The amount of metal charge is typically between about 2% and about 12% of the mass of the amount of grinding media provided in the ball mill. In some embodiments, the amount of grinding media may be between about 35% and about 45% of the internal mill volume, that is, the volume of the internal chamber of the mill.

While, as stated, in a broad sense, the method of the present disclosure is applicable generally to the preparation of metal flakes, it is found to be especially advantageous for the manufacture of lamellar zinc particles, and accordingly, the latter application constitutes an important aspect of the disclosure.

Thus, in an exemplary instance of such operation, incorporating the features described above, metal powder comprising zinc or an appropriate alloy thereof may be charged into a ball mill, processed in the presence of dry additives for a specific period of time at a desired internal mill temperature range. The resulting product may then be processed to separate grinding media from the resulting metal flake product and to screen out anomalous agglomerations and oversized particles to achieve the desired particle distribution in the form of a metal flake product comprising desirable lamellar zinc flakes exhibiting improved adhesive and cohesive properties.

Internal mill temperature is critical to the desired surface properties of the lamellar particles produced according to the method of the present disclosure, and the internal mill temperature may vary in some instances based upon the type of lubricant used in the milling process. With respect to temperature control, it is preferred to provide an internal temperature of the mill within the temperature range specified in this disclosure in order to improve the milling operation. More specifically, in some embodiments, the internal mill temperature ranges from between about 140° F. and about 380° F. In other embodiments, the method provides for an internal mill temperature between about 160° F. and about 220° F. In one embodiment, the method provides an internal mill temperature of between about 175° F. and about 205° F. In another embodiment, the mill temperature is maintained at about 190° F. during the milling process.

The appropriate milling time ranges between about 6 hours and about 18 hours. However, milling time will vary, in part, due to the real-time morphological state of particles in the mill. In some embodiments the milling time will range from about 14 to about 16 hours. In other embodiments, the milling time will range from about 6 hours to about 8 hours. In still other embodiments of the method of the present disclosure, the milling time will range from about 12 hours to about 18 hours. In even further embodiments, the milling time will range from about 14 to about 18 hours or from about 16 hours to about 18 hours.

The product of the described milling method is a metal flake product comprising lamellar metal particles. The metal flake product is removed from the mill chamber, and it comprises a wide range of desirable particle sizes, measuring from about 1 to about 70 microns in at least one aspect. The metal flake product may be processed to separate out anomalous agglomerations and oversized particles in order to achieve a desired particle distribution.

In some embodiments, at least about 90% of the lamellar particles of the metal flake product are less than 45 microns in major dimension. In some embodiments, the desired particle distribution will comprise at least about 90% particles having a major dimension and a minor dimension, wherein the major dimension is less than about 45 microns in length. In some embodiments, the lamellar particles of the metal flake product will have a thickness that is less than about 2 μm. The lamellar metal particles of the metal flake product have superior adhesive and cohesive properties than were heretofore obtainable. The lamellar metal particles are suitable for many uses, including use as a component of coating materials.

Although the foregoing procedure is described as applied to the manufacture of lamellar zinc particles, it will be appreciated that other metals may be used in place of or together with zinc. Other examples of metals that may be used in the method of the present disclosure include, for example, copper, aluminum and various alloys of these metals, or any mixture thereof.

The lamellar zinc particles produced by the method of the present disclosure, especially when they are oriented or aligned in coatings, impart to the coatings desirable properties, such as excellent adhesive and cohesive properties as compared with known metal powders in particulate form.

In an embodiment, the present disclosure is directed to a process for making a zinc flake-containing coating composition, wherein the composition can provide an adherent and corrosion-resistant coating for a metal substrate. The process comprises mechanically flattening the zinc particles and admixing the zinc flake particles with a coating composition and mixing and blending the ingredients to prepare a zinc-flake-containing coating composition. The zinc particles may be mechanically flattened by a milling method such as that described herein. Moreover, the metal flakes produced by the milling method of the present disclosure can be used in the form of powders, pastes, or slurries, for example. Further, the coating composition comprising such metal flakes can be water-based or solvent-based.

Such a coating composition may be applied to a metal substrate by any conventional method for coating a substrate with a liquid, for example, by dip coating, roller coating, or combinations of techniques such as, for example, spray and brush techniques. It is to be understood that in making a coating composition, a portion of the total metal flake may be a metal flake other than zinc, for example, a minor amount of the flake may be aluminum flake. Other metals may be present in the coating compositions but, even in combination, are typically present in minor amounts.

The zinc flakes produced by the method of the present disclosure may be included in zinc flake paints that may be used as a cathodic base coat that allows for electrodeposition of a top coat thereon. And as shown in FIGS. 1-3, a coating comprising the metal particles produced by the method of the present disclosure exhibit improved adhesive and cohesive properties as compared to the prior art.

Figure 2:
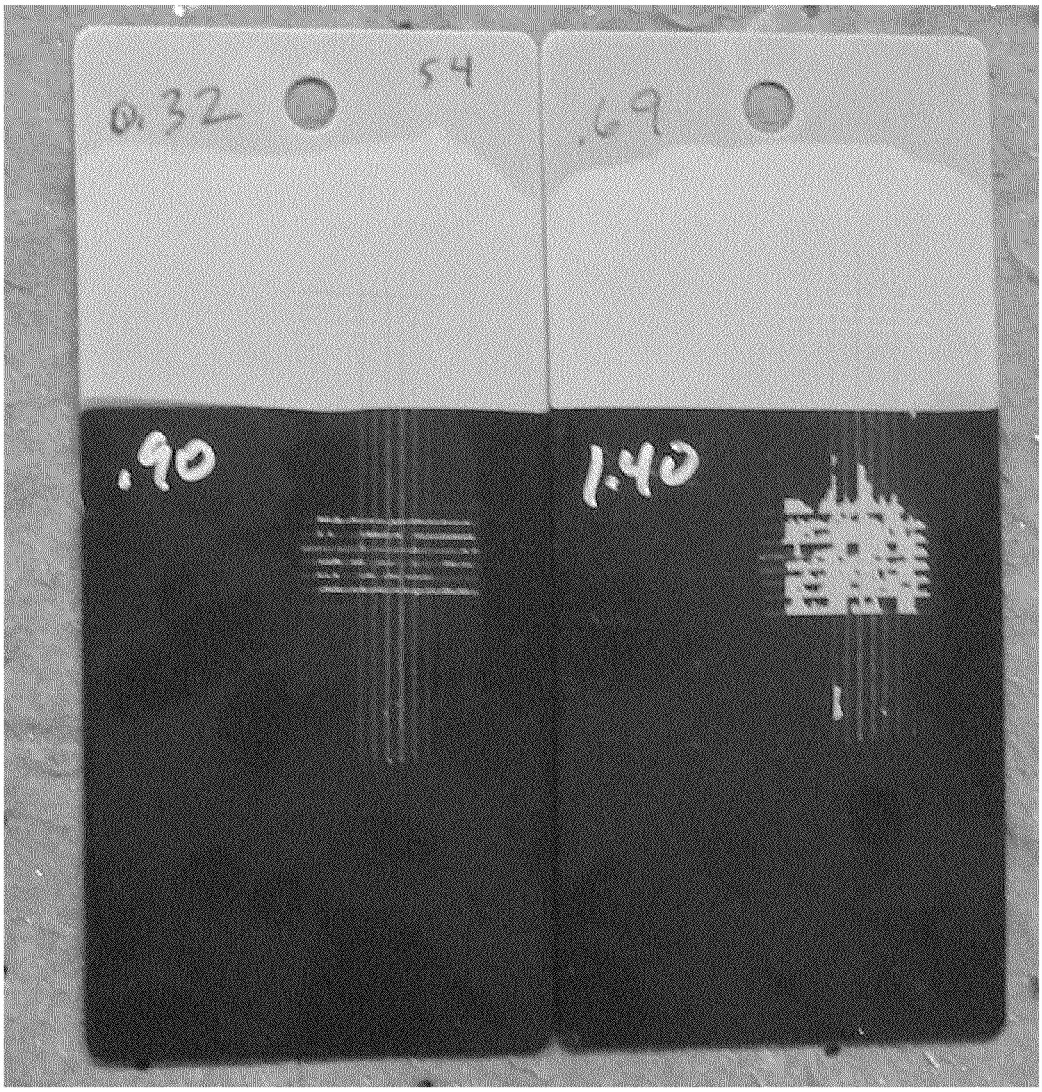
FIG. 2 is a photograph of the results of an ASTM Test Method D 3359, method B paint adhesion test.
Figure 3:
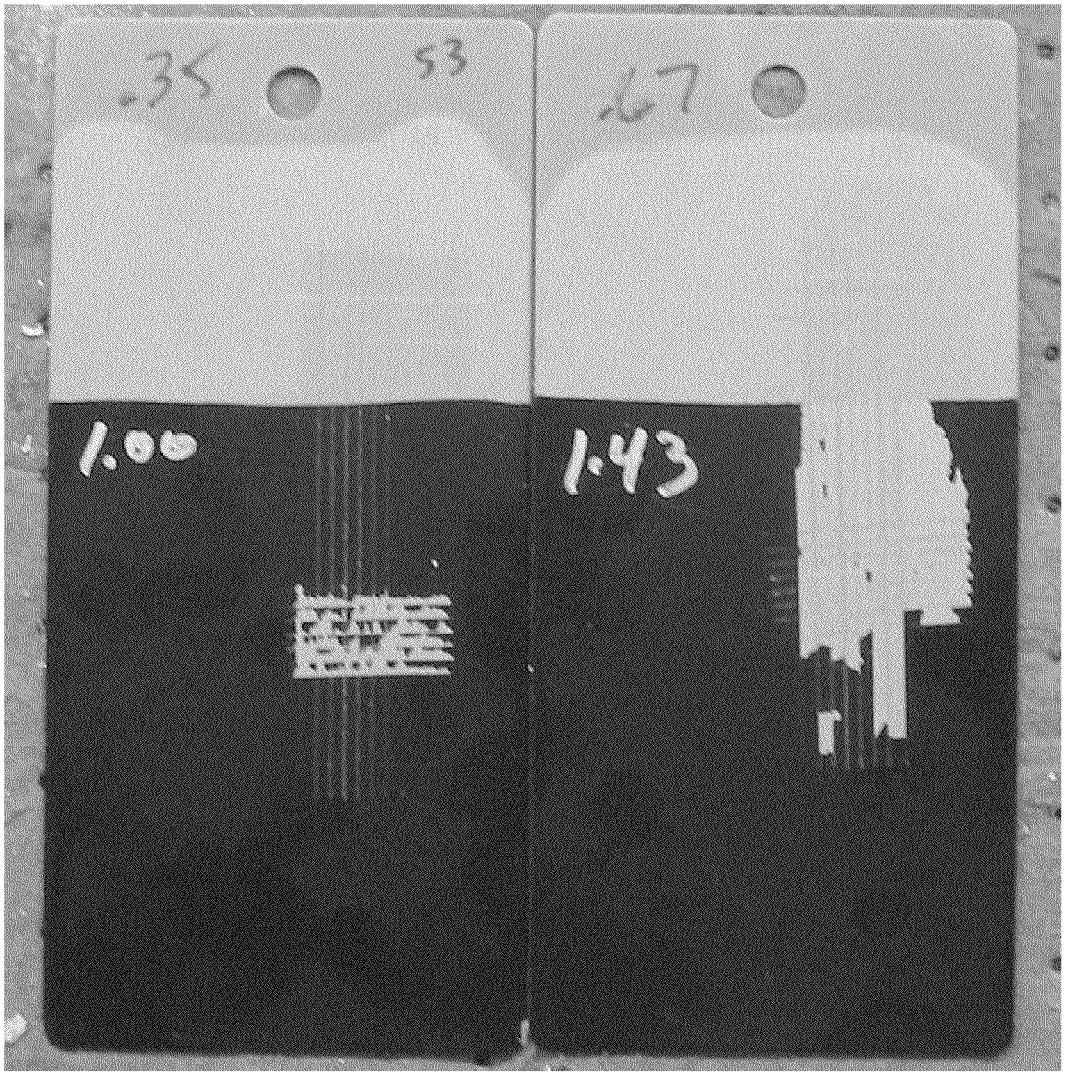
FIG. 3 is a photograph of the results of an ASTM Test Method D 3359, method B paint adhesion test.

FIGS. 1-3 are photographs of the results of a paint adhesion test, ASTM Test Method D 3359, method B. Each of FIGS. 1-3 shows two 2.75"×5.75" steel panels that are pretreated with zinc phosphate. The panels are then coated with base coats containing zinc flakes. The base coats are shown in FIGS. 1-3 as the light gray paint in the top third of the panel, and the base coats cover the entire area of the panel other than the very top area, which is visible as a different shade of grey surrounding a hole in each of the panels.

On each of the panels shown in FIGS. 1-3, the thickness of the base coat is written at the top of each panel and is expressed in mil (1/1000th of an inch). Thus, the thickness of the base coat on each panel is as follows:

TABLE 1

| Thickness of base coat (in mil) | | | |
|---|---|---|---|
| | FIG. 1 | FIG. 2 | FIG. 3 |
| Left panel | 0.35 | 0.35 | 0.32 |
| Right panel | 0.68 | 0.67 | 0.66 |

The base coat applied to each panel is cured according to the paint manufacturer's recommendations. The base coats are then top coated using a known electrodeposition technique.

Subsequently, a bladed tool is drawn across the surface of each panel, and a special tape is applied. The tape is ripped off in order to evaluate how strongly the base coat is attached to the substrate and how strongly the top coat is attached to the base coat. Evaluation of the test results is made by visual comparison of how much coating comes off with the tape.

FIG. 1 displays the results of the testing on a product comprising zinc particles that are manufactured according to the method of the present disclosure. FIGS. 2 and 3 show the results of the testing of products containing other zinc flake materials. The only zinc flake coating that passed the adhesion test is the coating comprising zinc flakes according to the present disclosure.

Metal flakes, particularly zinc flakes, produced according to the method(s) of the present disclosure have, of course, many uses other than in paints or coating materials. The particular characteristics of the flakes according to the invention and the method of producing the flakes render these flakes particularly advantageous.

The zinc flakes produced by the method of the present disclosure may be added to isocyanates, titanates, titanate hybrids and other compatible binder compositions. The unique additives and the physics of the disclosed milling technique produce zinc flakes that provide improved substrate adhesion and superior cohesion characteristics when used in conjunction with electrodeposition top coating. The produced lamellar zinc particles may be used in high-performance coatings and may be included in certain modern binder chemistries and may be used in conjunction with advanced modern top coating techniques, such as electrodeposition.

The present disclosure provides a method of producing lamellar zinc particles that are compatible with the binder chemistries and topcoats mentioned above as well as those binder chemistries and topcoats known to one of skill in the art. A binder may be selected to further improve adherence of the zinc flakes to each other and to the underlying substrate, and the binder may be selected such that it will withstand the environment to which a coating is exposed.

Various combinations of method or process steps as used herein can be performed in any order known or understood by one of skill in the art, unless otherwise specified or clearly implied to the contrary by the context in which the referenced combination is made.

Further features and advantages of the method(s) of the present disclosure and the novel metal particles produced therefrom will be apparent from the following specific example of production of flake metal powders in accordance with the present method. In the example, percentage values (where given) of grinding media and other components used in the milling process refer to the mass of the component supplied to the mill, expressed in relation to the mass of the metal charge unless otherwise specified.

The following examples are provided to illustrate the inventions of the present disclosure but should not be interpreted as a limitation thereon.

EXAMPLE

Zinc flakes are produced in accordance with the method of the present disclosure in a ball mill. In a series of runs, zinc metal particle charge is milled to lamellar form in order to produce several samples of product.

A ball mill containing an amount of steel grinding media comprising up to about 40% of the volume of the ball mill is charged with 300 lbs zinc dust, 7.5 lbs stearic acid, and 1.5 lbs natural graphite. The mill is operated at 25 rpm for between about 14 and about 16 hours. The mill is operated such that the internal temperature is provided at about +15% of 190° F. The contents of the ball mill are then removed from the mill when they are emptied into an apparatus suitable to separate the milling media from the metal flake product. The raw metal flake product is then screened such that at least about 90% of the product particles are smaller than 45 microns in their major dimension.

Although preferred embodiments of the disclosure have been described using specific terms, devices, and methods, such description is for illustrative purposes only. The words used are words of description rather than of limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. For example, while methods for the production of lamellar zinc particles made according to those methods have been exemplified, other uses are contemplated. Therefore, the spirit and scope of the appended claims should not be limited to the description of the preferred versions contained therein.

What is claimed is:

1. A method of producing lamellar metal particles in a ball mill, wherein the ball mill comprises an internal mill chamber and further wherein the internal mill chamber contains an amount of grinding media having a mass, the method comprising the steps of:

(i) adding an amount of a metal charge having a mass that is between about 2% and about 12% of the mass of the grinding media to the internal mill chamber;

(ii) adding an amount of a milling lubricant that is between about 0.75% and about 3% of the mass of the metal charge to the internal mill chamber;

(iii) adding an amount of an anti-welding additive that is between about 0.15% and about 3.5% of the mass of the metal charge to the internal mill chamber;

(iv) dry milling the metal charge by operating the mill at between about 14 and about 45 rpm for between about 6 and about 18 hours;

(v) providing a mill chamber temperature of between about 140° F. and about 380° F.; and (vi) removing a metal flake product from the mill chamber, wherein the metal flake product comprises lamellar particles ranging in size from between about 1 and about 110 microns in major dimension.

2. The method of claim 1, wherein the internal mill chamber has a volume and further wherein the amount of grinding media is between about 35% and about 45% of the mill chamber volume.

3. The method of claim 1, wherein the milling lubricant comprises stearic acid.

4. The method of claim 1, wherein the milling lubricant comprises lauric acid.

5. The method of claim 1, wherein the anti-welding additive comprises an amorphous carbon substance.

6. The method of claim 5, wherein the amorphous carbon substance comprises natural graphite.

7. The method of claim 1, wherein the metal flake product comprises lamellar particles ranging in size from between about 1 and about 70 microns.

8. The method of claim 1, wherein at least 90% of the lamellar particles of the metal flake product are less than 45 microns in major dimension.

9. The method of claim 1, wherein the metal charge comprises zinc.

10. A method of producing zinc flake in a ball mill, the method comprising the steps of:

(i) adding to the mill between about 250 and about 350 lbs of metal charge, wherein the metal charge comprises zinc;

(ii) adding to the mill between about 2.25 lbs and about 9 lbs of stearic acid;

(iii) adding to the mill between about 0.45 and about 10.5 lbs of amorphous carbon substance;

(iv) rotating the mill at between about 20 and about 30 rotations per minute for between about 12 and about 18 hours;

(v) providing an internal mill temperature of between about 160° F. and about 220° F.; and (vi) removing a metal flake product from the mill, wherein the metal flake product comprises zinc flakes ranging in size from between about 1 and about 110 microns in major dimension.

11. The method of claim 10, wherein the metal flake product comprises zinc flakes ranging in size from between about 1 and about 70 microns.

12. The method of claim 10, wherein at least 90% of the zinc flakes of the metal flake product are less than 45 microns in major dimension.

13. The method of claim 10, wherein the mill is rotated at about 25 rotations per minute for between about 14 and about 16 hours.

14. The method of claim 10, wherein the amorphous carbon substance comprises natural graphite.

15. The method of claim 10, wherein the metal charge comprises spherical zinc dust.

16. The method of claim 10, wherein the metal charge comprises zinc powder.

* * * * *